US011339958B2

(12) United States Patent
Ye et al.

(10) Patent No.: US 11,339,958 B2
(45) Date of Patent: May 24, 2022

(54) LIGHTING APPARATUS

(71) Applicant: XIAMEN LEEDARSON LIGHTING CO., LTD, Fujian (CN)

(72) Inventors: Hemu Ye, Fujian (CN); Jinglong Chen, Fujian (CN); Yankun Li, Fujian (CN); Qiyi Jiang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/169,219

(22) Filed: Feb. 5, 2021

(65) Prior Publication Data

US 2021/0270451 A1 Sep. 2, 2021

(30) Foreign Application Priority Data

Feb. 28, 2020 (CN) ..... 202020232302.2

(51) Int. Cl.

| | |
|---|---|
| ***F21V 23/00*** | (2015.01) |
| ***F21V 5/04*** | (2006.01) |
| ***F21V 19/00*** | (2006.01) |
| ***F21V 7/04*** | (2006.01) |
| ***F21Y 103/10*** | (2016.01) |
| ***F21Y 115/10*** | (2016.01) |

(52) U.S. Cl.

CPC ..... *F21V 23/001* (2013.01); *F21V 5/04* (2013.01); *F21V 7/04* (2013.01); *F21V 19/0055* (2013.01); *F21V 23/003* (2013.01); *F21Y 2103/10* (2016.08); *F21Y 2115/10* (2016.08)

(58) Field of Classification Search

CPC . F21V 23/001; F21V 5/04; F21V 7/04; F21V 19/0055; F21V 23/003

USPC ..... 362/217.02

See application file for complete search history.

(56) References Cited

U.S. PATENT DOCUMENTS

| | | | | |
|---|---|---|---|---|
| 11,085,599 | B2 * | 8/2021 | Bernard | F21V 17/002 |
| 2004/0251953 | A1 * | 12/2004 | Yamazaki | F21V 23/06 327/512 |
| 2017/0321849 | A1 * | 11/2017 | Xiong | H05B 45/375 |
| 2018/0224074 | A1 * | 8/2018 | Xiong | F21K 9/272 |
| 2019/0032864 | A1 * | 1/2019 | Xiong | F21K 9/272 |
| 2019/0242534 | A1 * | 8/2019 | Xiong | F21V 29/70 |
| 2020/0182440 | A1 * | 6/2020 | Casanova | F21V 29/70 |
| 2020/0256521 | A1 * | 8/2020 | Xiong | F21V 23/023 |
| 2021/0280967 | A1 * | 9/2021 | Wu | F21V 23/003 |
| 2021/0282251 | A1 * | 9/2021 | Wu | F21V 23/045 |

* cited by examiner

*Primary Examiner* — Bryon T Gyllstrom
(74) *Attorney, Agent, or Firm* — Chun-Ming Shih; Lanway IPR Services

(57) ABSTRACT

A lighting apparatus includes a driver, a metal plate, a light source module and a conductor unit. The driver receives an alternating current power source and converts the alternating current power source to a driving current. The metal plate is electrically connected to a ground. The light source module has a substrate and multiple LED modules. The multiple LED modules are mounted on the substrate. The substrate is disposed upon the metal plate. The conductor unit has a first end connected to the substrate of the light source module and a second end connected to the metal plate for removing a parasitic capacitance between the substrate of the light source and the metal plate for preventing a noise occurred when the LED module is turned on and the metal plate is connected to the ground.

20 Claims, 6 Drawing Sheets

LIGHTING APPARATUS

FIELD

The present invention is related to a lighting apparatus, and more particularly related to a lighting apparatus with noise cancellation function.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light devices contain various electrical components. On designing light devices, some issues and technical problems may occur due to undesired interaction among the electrical components.

It is important to notice such technical problems and find a way to solve the problems to provide a reliable product.

SUMMARY

In some embodiments, a lighting apparatus includes a driver, a metal plate, a light source module and a conductor unit.

The driver receives an alternating current power source and converts the alternating current power source to a driving current.

The metal plate is electrically connected to a ground.

The light source module has a substrate and multiple LED modules.

The multiple LED modules are mounted on the substrate.

The substrate is disposed upon the metal plate.

The conductor unit has a first end connected to the substrate of the light source module and a second end connected to the metal plate for removing a parasitic capacitance between the substrate of the light source and the metal plate for preventing a noise occurred when the LED module is turned on and the metal plate is connected to the ground.

In some embodiments, the alternating current power source varies the parasitic capacitance periodically to cause the noise.

In some embodiments, the conductor unit is a metal screw.

In some embodiments, the metal screw is interference tight fitting to a first hole the substrate of the light source module.

In some embodiments, the lighting apparatus may also include a light passing cover.

A peripheral area of the metal plate has a curve edge attaching to a cover edge of the light passing cover.

In some embodiments, the light source module has multiple light strips disposed upon the metal plate.

In some embodiments, the multiple light strips form a surrounding ring

In some embodiments, the driver is surrounded by the surrounding ring.

In some embodiments, each light strip has an elongated lens cover covering the multiple LED modules for diffusing lights of the multiple LED modules.

In some embodiments, a peripheral wall is formed at a peripheral area of the metal plate forming a concave container for loading the light source module.

In some embodiments, a reflector ring is placed in the concave container surrounding the light source module.

In some embodiments, the reflector ring enclosed the driver to keep the driver at a different side from the light source module.

In some embodiments, the metal plate has an insulation layer facing the light source module.

In some embodiments, the conductor unit breaks the insulation layer to electrically contact the metal plate.

In some embodiments, a capacitor is disposed for absorbing the parasitic capacitance between the metal plate and the light source module.

In some embodiments, a buffer layer is placed between the metal plate and the light source module.

In some embodiments, the driver is placed on the substrate of the light source module.

In some embodiments, the conductor unit is disposed on the substrate of the light source.

The conductor unit has an elastic reverse hook to be buckled to the metal plate.

In some embodiments, the conductor unit is disposed on the metal plate.

The conductor unit has an elastic reverse hook to be buckled to the substrate of the light source module.

In some embodiments, the conductor unit is a clip with the first end connected to the light source module and a second end connected to the metal plate.

DETAILED DESCRIPTION

Figure 5:
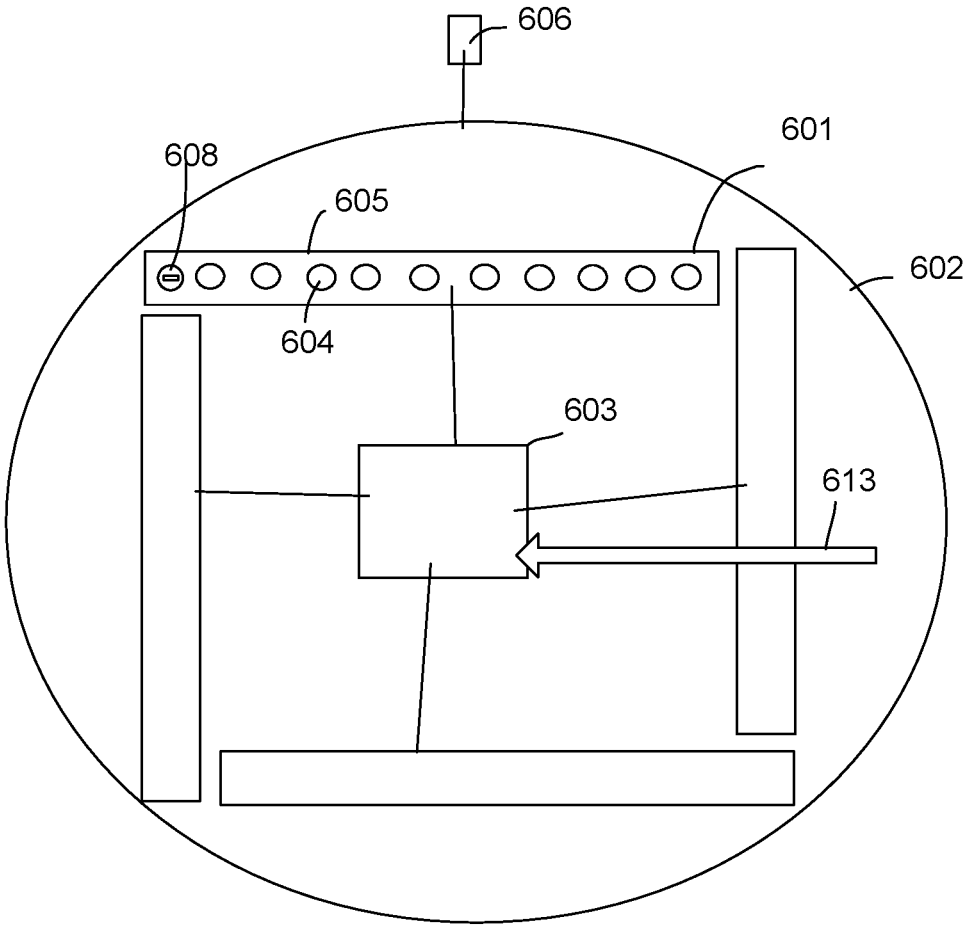
FIG. 5 illustrates another embodiment.

Please refer to FIG. 5, a lighting apparatus includes a driver 603, a metal plate 602, a light source module 601 and a conductor unit 608.

The driver 603 receives an alternating current power source 613 and converts the alternating current power source to a driving current. For example, the alternating current (AC) power source 613 may be an indoor 110V/220V power source. The driving current may be a direct current power suitable for driving LED modules.

The metal plate 602 is electrically connected to a ground 606 to provide a safe design. The ground 606 may be a metal unit or an indoor safety ground shared by multiple electrical devices. Such ground connection prevents the metal plate to cause human damages and other safety issues.

The light source module 601 has a substrate 605 and multiple LED modules 604.

The multiple LED modules 604 are mounted on the substrate 605. For example, the substrate 605 may include an elongated metal bar disposed with conductive paths for connecting the LED modules 604, an insulation layer and a heat dissipation layer for heat dissipation. The heat dissipation layer may be made of aluminum material.

Figure 6:
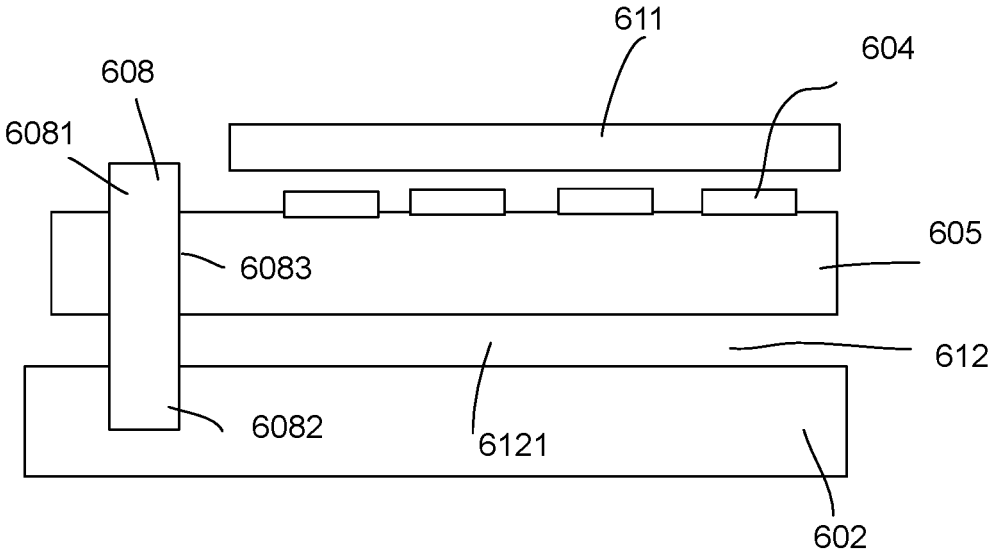
FIG. 6 shows a side view of the example in FIG. 5.

Please also refer to FIG. 6, which shows a side view of the example in FIG. 5. FIG. 6 shows a more clear view on spatial relation among components in the example of FIG. 5. The substrate 605 is disposed upon the metal plate 602.

The conductor unit 608 has a first end 6081 connected to the substrate 605 of the light source module and a second end 6082 connected to the metal plate 602 for removing a parasitic capacitance 612 between the substrate 605 of the light source and the metal plate 602 for preventing a noise occurred when the LED module 604 is turned on and the metal plate 602 is connected to the ground.

A lens cover 611 is placed over the LED modules 64 for diffusing the lights of the LED modules 64.

It is found that when the light source module is directly placed upon the metal plate, there is certain gap 6121 between the substrate of the light source and the metal plate. In addition, some substrate has an insulation layer at its bottom facing to the metal plate. When the light source module is charged with an alternating power source, the electro-magnetic field between the In some embodiments, the alternating current power source varies the parasitic capacitance periodically to cause the noise.

In some embodiments, the conductor unit is a metal screw.

In FIG. 6, the metal screw is interference tight fitting to a first hole 6083 of the substrate 605 of the light source module.

Figure 4:
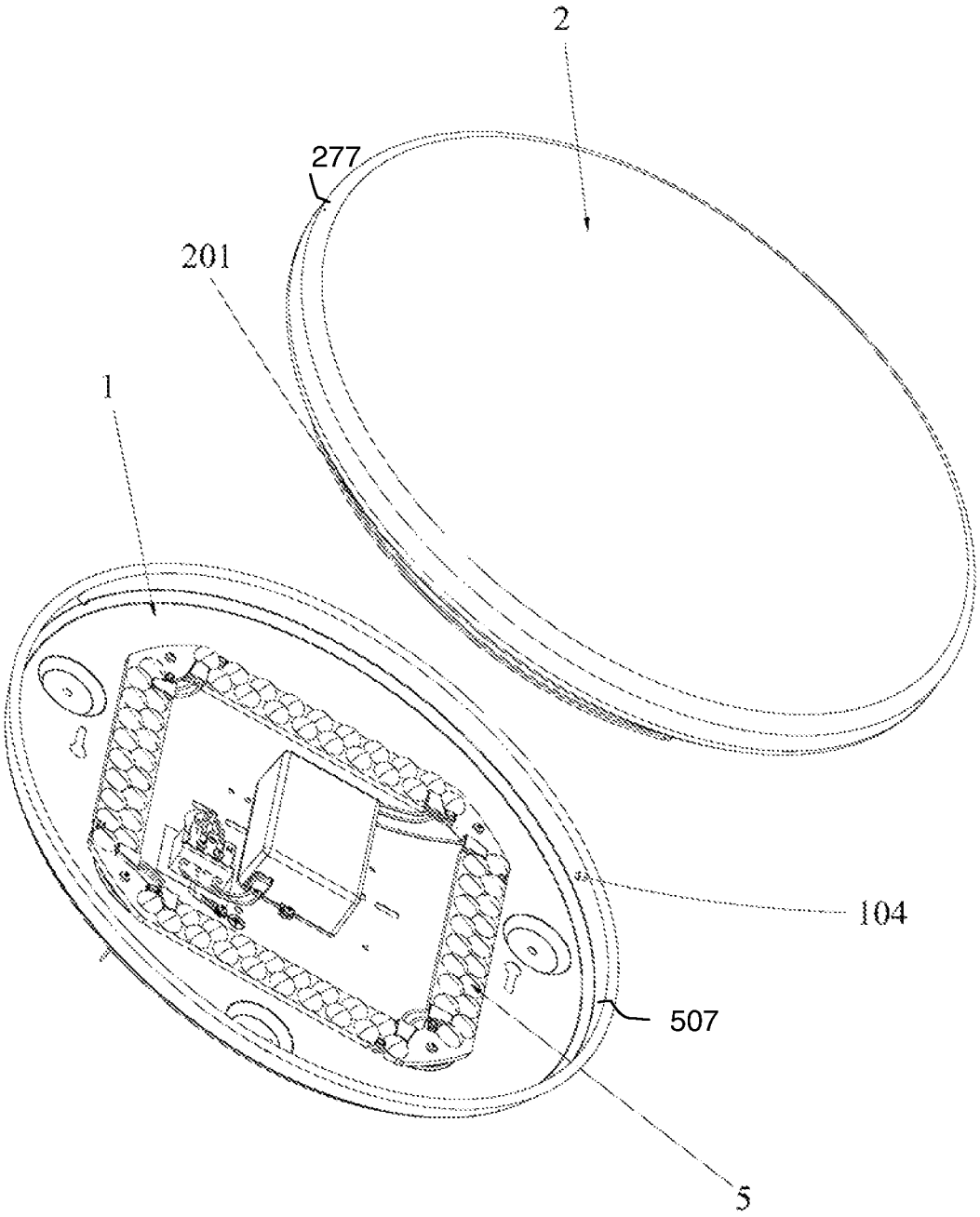
FIG. 4 illustrates an exploded view of components in the example of FIG. 1.

In FIG. 4, the lighting apparatus may also include a light passing cover 2.

A peripheral area of the metal plate has a curve edge 507 attaching to a cover edge 277 of the light passing cover 2.

In some embodiments, the light source module has multiple light strips disposed upon the metal plate, as the example of FIG. 4 showing four light strips aligned as a rectangular shape.

In some embodiments, the multiple light strips form a surrounding ring, as the example of FIG. 4.

In some embodiments, the driver 603 is surrounded by the surrounding ring.

In some embodiments, each light strip has an elongated lens cover covering the multiple LED modules for diffusing lights of the multiple LED modules.

Figure 7:
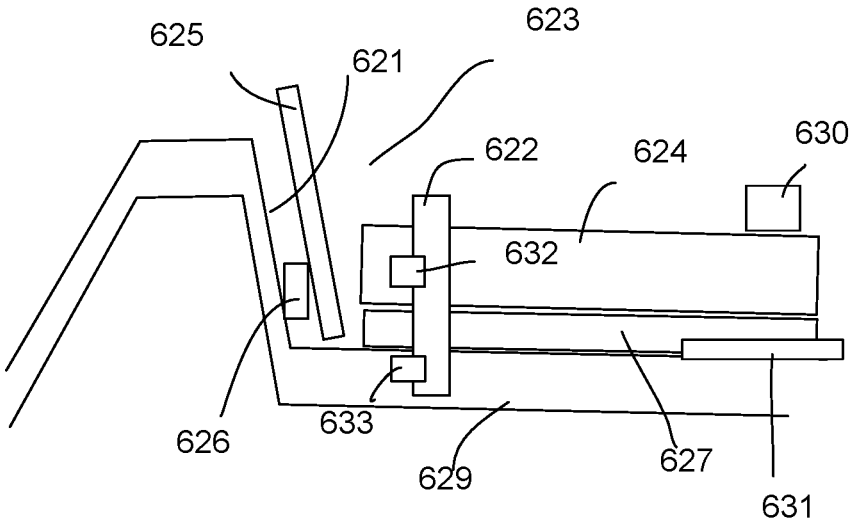
FIG. 7 shows another embodiment of a lighting apparatus.

In FIG. 7, a peripheral wall is formed at a peripheral area of the metal plate forming a concave container for loading the light source module.

In some embodiments, a reflector ring is placed in the concave container 623 surrounding the light source module 624.

In some embodiments, the reflector ring 625 enclosed the driver 626 to keep the driver 626 at a different side from the light source module 624.

In some embodiments, the metal plate has an insulation layer 627 facing the light source module 624.

In some embodiments, the conductor unit 622 breaks the insulation layer 627 to electrically contact the metal plate 629.

In some embodiments, a capacitor 630 is disposed for absorbing the parasitic capacitance between the metal plate and the light source module.

In some embodiments, a buffer layer 631 is placed between the metal plate and the light source module.

In some embodiments, the driver is placed on the substrate of the light source module.

In some embodiments, the conductor unit is disposed on the substrate of the light source.

In FIG. 7, the conductor unit 622 has an elastic reverse hook 633 to be buckled to the metal plate.

In some embodiments, the conductor unit is disposed on the metal plate.

The conductor unit has an elastic reverse hook 632 to be buckled to the substrate of the light source module.

In some embodiments, the conductor unit is a clip with the first end connected to the light source module and a second end connected to the metal plate.

Figure 1:
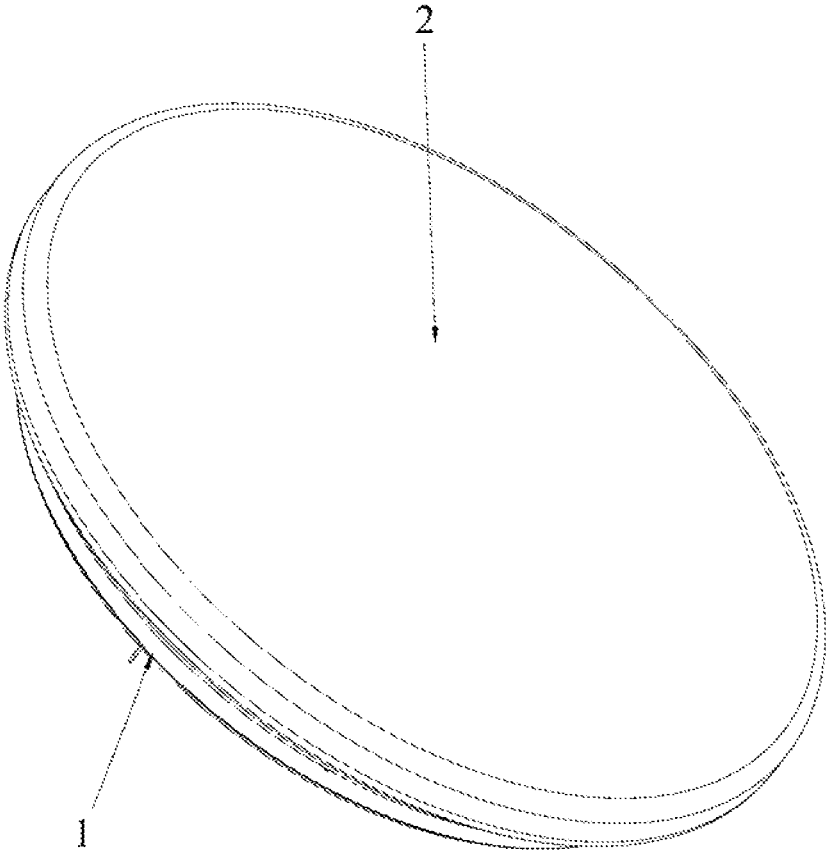
FIG. 1 illustrates a lighting apparatus embodiment.

Please refer to FIG. 1, which illustrates a lighting apparatus embodiment.

In FIG. 1, the lighting apparatus has a light passing cover 2 and a metal plate 1. The peripheral edges of the light cover 2 and the metal plate 1 are connected together.

Figure 2:
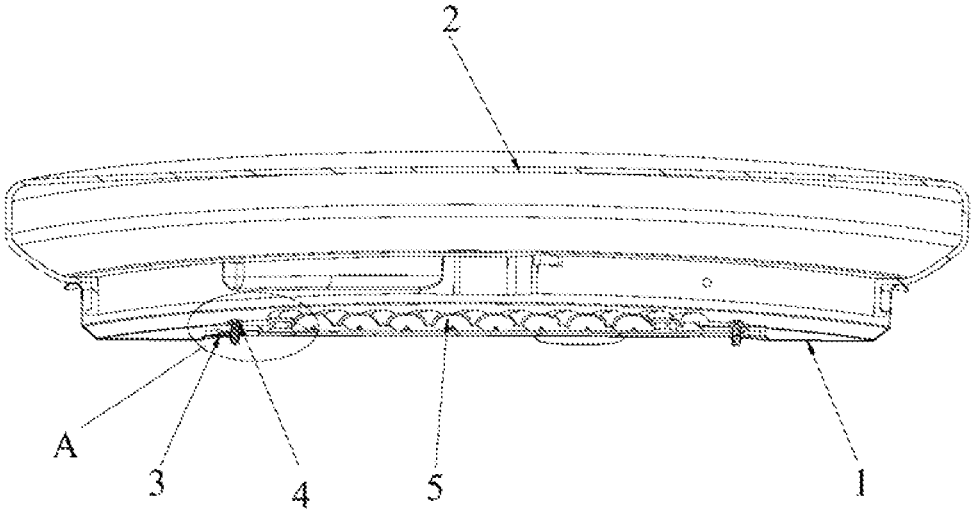
FIG. 2 illustrates a side view of the embodiment in FIG. 1.

Please refer to FIG. 2, which shows a side view of the example in FIG. 1.

In FIG. 2, the metal plate supports a light source module 5 that has a substrate 3 mounted with LED modules.

There is a conductor unit 4 for connecting the substate 3 and the metal plate 1.

Figure 3:
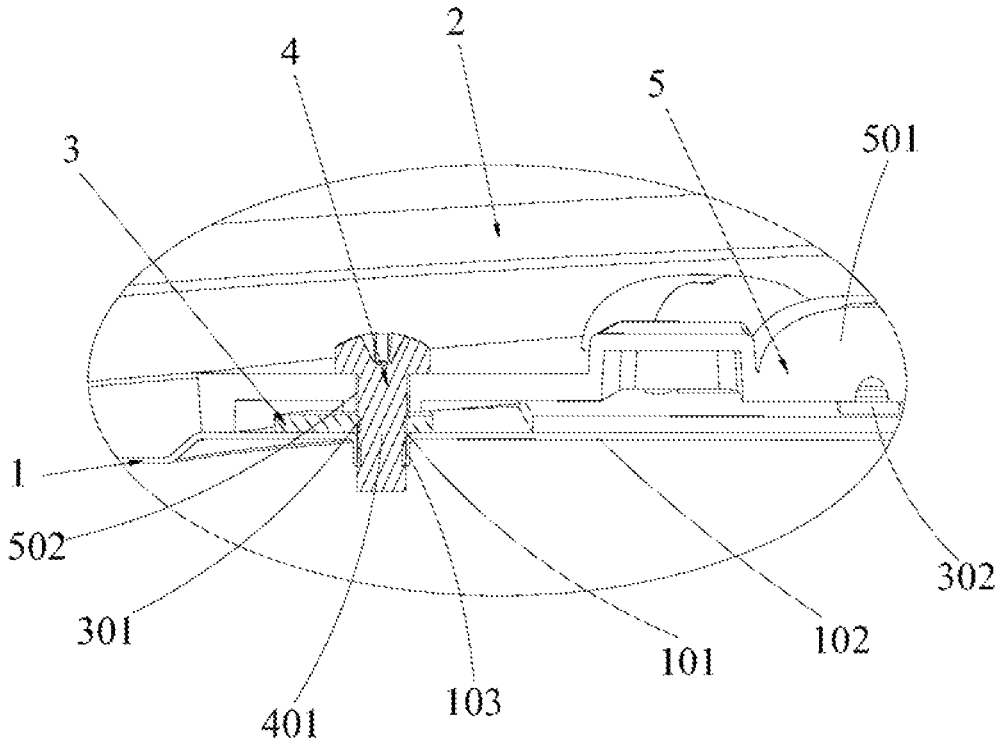
FIG. 3 illustrates a zoom-up view of a conductor unit in the example in FIG. 1.

Please refer to FIG. 3, which illustrates a zoom-up view of the example of FIG. 1.

In FIG. 3, in addition to the components mentioned above, the conductor unit 4 is a screw passing through a first hole 502 of a lens cover 501 that diffuses the light of the LED module 302 of the light source module 5.

In addition, the conductor unit 4 also passes through a second hole 301 of the substate 3 and then passes through a third hole 101 of the metal plate 1. The diameter of the screw is set a little larger than the first hole 502, 301, 101 to interference tight fitting connected the metal plate and the substate of the light source module. There is a receiver structure 103 disposed on the metal plate 1 to receive the conductor unit 4. The metal plate 1 has a platform 102 for mounting the light source module.

Please refer to FIG. 4. The light passing cover 2 has a connector edge 201 for connecting to the lateral wall 507 of the metal plate 1.

The light source module 5 has four light strips forming a surrounding rectangular shape. Connector columns 104 are used for connecting the light passing cover 2.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a driver for receiving an alternating current power source and converting the alternating current power source to a driving current;

a metal plate electrically connected to a ground;

a light source module having a substrate and multiple LED modules, wherein the multiple LED modules are mounted on the substrate, the substrate is disposed upon the metal plate; and a conductor unit with a first end connected to the substrate of the light source module and a second end connected to the metal plate for removing a parasitic capacitance between the substrate of the light source and the metal plate for preventing a noise occurred when the LED module is turned on and the metal plate is connected to the ground.

2. The lighting apparatus of claim 1, wherein the alternating current power source varies the parasitic capacitance periodically to cause the noise.

3. The lighting apparatus of claim 1, wherein the conductor unit is a metal screw.

4. The lighting apparatus of claim 3, wherein the metal screw is interference tight fitting to a first hole the substrate of the light source module.

5. The lighting apparatus of claim 1, further comprising a light passing cover, wherein a peripheral area of the metal plate has a curve edge attaching to a cover edge of the light passing cover.

6. The lighting apparatus of claim 1, wherein the light source module has multiple light strips disposed upon the metal plate.

7. The lighting apparatus of claim 6, wherein the multiple light strips form a surrounding ring.

8. The lighting apparatus of claim 7, wherein the driver is surrounded by the surrounding ring.

9. The lighting apparatus of claim 6, wherein each light strip has an elongated lens cover covering the multiple LED modules for diffusing lights of the multiple LED modules.

10. The lighting apparatus of claim 1, wherein a peripheral wall is formed at a peripheral area of the metal plate forming a concave container for loading the light source module.

11. The lighting apparatus of claim 10, wherein a reflector ring is placed in the concave container surrounding the light source module.

12. The lighting apparatus of claim 11, wherein the reflector ring enclosed the driver to keep the driver at a different side from the light source module.

13. The lighting apparatus of claim 10, wherein the metal plate has an insulation layer facing the light source module.

14. The lighting apparatus of claim 13, wherein the conductor unit breaks the insulation layer to electrically contact the metal plate.

15. The lighting apparatus of claim 1, wherein a capacitor is disposed for absorbing the parasitic capacitance between the metal plate and the light source module.

16. The lighting apparatus of claim 1, wherein a buffer layer is placed between the metal plate and the light source module.

17. The lighting apparatus of claim 1, wherein the driver is placed on the substrate of the light source module.

18. The lighting apparatus of claim 1, wherein the conductor unit is disposed on the substrate of the light source, the conductor unit has an elastic reverse hook to be buckled to the metal plate.

19. The lighting apparatus of claim 1, wherein the conductor unit is disposed on the metal plate, the conductor unit has an elastic reverse hook to be buckled to the substrate of the light source module.

20. The lighting apparatus of claim 1, wherein the conductor unit is a clip with the first end connected to the light source module and a second end connected to the metal plate.

* * * * *